US006263628B1

(12) United States Patent
Griffin G. E. Steel Company

(10) Patent No.: US 6,263,628 B1
(45) Date of Patent: Jul. 24, 2001

(54) LOAD BEARING BUILDING COMPONENT AND WALL ASSEMBLY METHOD

(76) Inventor: John Griffin G. E. Steel Company, 4646 N.W. 8th Way, Fort Lauderdale, FL (US) 33309

( * ) Notice: Subject to any disclaimer, the term of this patent is extended or adjusted under 35 U.S.C. 154(b) by 0 days.

(21) Appl. No.: 09/294,903

(22) Filed: Apr. 21, 1999

(51) Int. Cl.[7] ..... E04C 1/00

(52) U.S. Cl. ..... 52/309.12; 52/309.7; 52/309.9; 52/309.11; 52/630; 52/754.1; 52/801.11

(58) Field of Search ..... 52/309.7, 309.9, 52/309.11, 630, 794.1, 801.11

(56) References Cited

U.S. PATENT DOCUMENTS 4,903,446 * 2/1990 Richards et al. ..... 52/223
5,722,198 * 3/1998 Bader ..... 52/745.09
5,839,249 * 11/1998 Roberts ..... 52/745.08

* cited by examiner

*Primary Examiner*—Beth A. Stephan
*Assistant Examiner*—Patrick J. Chavez
(74) *Attorney, Agent, or Firm*—H. John Griffin II

(57) ABSTRACT

Disclosed is a panel building component, method of making same, and method of fabricating a load-bearing, insulating building wall using the panels and concrete pour after the panels are positioned on site. The panel includes at least one foam core, vertical C-studs, a channel shaped foot member in engaging relationship with the bottom edge of the foam core and the bottom end of the C-studs, two siding members, spacers to keep the foam core centered between the siding members prior to filling the panel with concrete, and the concrete itself. The foam core and C-studs are fabricated shorter than the finished height of the panel so that rebar steel reinforcing rods can be laid horizontally such that when the panel is filled with concrete, the top portion will be a concrete and rebar tie beam. The method of making same is simply assembly of the foregoing components, less the concrete. The method of assembling a load-bearing wall includes fixing vertical rebar to the foundation, placing a first panel building component having a top void onto a foundation between vertical rebar, orienting the panel vertically so that the vertical rebar is disposed inside outwardly facing C-studs at the edges of each panel, placing a second panel building component having a top void onto the foundation, orienting the second panel in an upright position adjacent to the first panel between vertical rebars, positioning rebar horizontally in the top void of both panels, and filling both panels with concrete.

3 Claims, 3 Drawing Sheets

LOAD BEARING BUILDING COMPONENT AND WALL ASSEMBLY METHOD

FIELD OF THE INVENTION

The present invention relates to the field of building construction using modular building components and, more particularly, to a building component and a method of using same to assemble a load bearing, insulating wall. The design is such that can be safely executed by two workmen without lifting equipment and it achieves great insulation and strength with light handling weight by using a composite of materials to which is added concrete after handling is completed.

BACKGROUND OF THE INVENTION

Much of the construction of buildings in the industrialized world, particularly in the United States, is of three types, wood frame and various kinds of material, including wood to cover the framework, heavy (red iron) steel, usually used in combination with concrete for framing and a variety of other materials to cover the same, frequently concrete block, and light gauge steel used similarly to wood framing as mentioned above. On larger buildings, a prestressed concrete frame may be covered by glass, marble, stone, or the like. In all of the above cases, insulation, which has become ever more important in an increasingly energy conscious world, is frequently supplied as a separate layer to the interior and the exterior of the outside structure above described. When the covering material is concrete block, there is typically no insulation installed.

In order to achieve economies in the cost of construction, various efforts have been made to utilize prefabricated materials. An excellent example in prefabrication is with mobile homes which are simply transported to the residence site, and then permanently fixed to a foundation. Other types of pre-fabricated or partially prefabricated construction methods are also well known such as A-frame homes that are frequently used in rural areas as vacation retreats. There have also been very sophisticated structures such as geodesic dome type structures of a type advocated by the well known American inventor Richard Buckminster Fuller. Examples of United States patents of this species either by Fuller or his associates are U.S. Pat. No. 2,682,235 for a geodesic dome, U.S. Pat. No. 2,881,717 for a paper board dome, U.S. Pat. No. 2,905,113 for a plydome, U.S. Pat. No. 2,914,074 for a catenary (geodesic tent), and other similar references such as U.S. Pat. No. 3,063,521, U.S. Pat. No. 3,139,957, U.S. Pat. No. 3,197,927, U.S. Pat. No. 3,203,144, and U.S. Pat. No. 3,810,336.

Another reference which pursues the notion of a building component utilizing a panel is Zeihbrunner, U.S. Pat. No. 4,646,502 which teaches a panel construction element and building construction system employing such elements. That reference illustrates a profile frame and a filler material with cover panels that cover both the filler material and the profile frame. The frame includes a complex cross-section of a type fabricated using an extrusion, which, in turn, leads to a substantially more expensive structure than that provided by the present invention without the interlocking advantages of concrete of the present invention.

Similarly, efforts have been made to provide methods of construction using modular building components which produce building walls combining the coverage of area with insulation benefits. Several of these include two patents to Meyerson, U.S. Pat. Nos. 4,769,963 and 5,086,599, both of which involve utilizing an expanded polymeric material taken in combination with aluminum sheet to produce a building panel with excellent insulation properties in a light weight construction component. To the extent that an expanded polymeric material is utilized in these references, they bear some resemblance to the present invention. However, the resulting walls lack any significant structural strength because they are merely the combination of flat and folded aluminum or similar type material in combination with the expanded polymeric material.

Nemmer, et al., U.S. Pat. No. 4,633,634, issued on Jan. 6, 1987, discloses a building side wall construction panel and method. Nemmer includes foam cores connected edge to edge by connecting studs, the studs being two C-shaped channels welded back-to-back. To assemble Nemmer, the studs are secured upright and the foam cores are slid vertically downward into the open C-shaped sides of the studs. A problem with the Nemmer method is that a workman would have to carry tall and possibly unwieldy foam cores to roof level and try to jam their edges into and all the way downward along the stud C-channels to the level of the foundation. This precarious procedure is difficult and places the workman at risk. The double C-shape stud design makes it impossible for the workman to set the cores individually into place from ground level.

Switzerland Patent Number 396,368 teaches an interior wall panel assembly. The back-to-back C-shaped studs require either the procedure set forth in Nemmer where cores are forced downward from roof level, or prefabrication of the entire wall in a horizontal plane followed by tilting the wall upright. A complete wall would be heavy and dangerously cumbersome for one or even several workmen to lift upright and position properly. Such a complete wall, if assembled off site, would also be prohibitively bulky and unwieldy to transport.

A rough translation of Switzerland patent 396,368 indicates that it discloses an interior panel which is not load-bearing. "It is quite known to use (provide) gauge frame and panel elements to build interior walls." Switzerland '368 patent, line 1. There is apparently no teaching that the panels (11, 12, 13, 14) are "rigid", and indeed they would not need to be rigid to function as non-load-bearing interior dividers or wall panels.

Finally, Bader, U.S. Pat. No. 5,711,133 teaches a method of building a composite assembly that may be utilized for the construction of building walls using steel in an interlocking relationship with an expanded polymeric material such as polystyrene or polyurethane. The steel provides strength in both tension and compression as in the present invention, while the expanded polymeric material provides thermal and sound insulation and substantial support in compression also as in the present invention. However, Bader lacks the strength and load-bearing capability of the present invention that is supplied by concrete that is poured after component placement has taken place.

The present invention relates to a panel building component, method of making same, and method of utilizing same in the construction of walls for a variety of structures and buildings. The preferred principal materials are a unique triplicate of (1) steel for structural strength, (2) an expanded polymeric material such as medium density polystyrene or polyurethane used for thermal and sound insulation, and (3) concrete that is applied in the field after panel placement has occurred. The expanded polymeric material serves the additional function of assisting in properly distributing the concrete in its field installation.

The steel provides strength in both tension and compression, while the expanded polymeric material provides both thermal and sound insulation. The concrete provides additional strength in compression, leading to greater load-bearing capability in combination with ease of construction than any of the prior art. The combination, therefore, provides a high level of structural strength, high insulation effects, and low cost resulting in part from pre-fabrication. The invention further features the ability to utilize external and internal facing materials that provide aesthetics, protection from the elements, functionality, some additional insulation, and minimal construction labor, especially avoiding highly paid skilled labor.

Indeed, the present inventive building component and method produce an excellent substitute for concrete block when the same is used with a prestressed concrete frame, and with the optional exterior and/or interior surfaces. It can also replace the materials normally applied to the exterior and/or interior of concrete block.

The present invention also relates to a building component and method of assembling a load-bearing, insulating building wall which permits two workmen to safely assemble an entire wall without the need for lifting equipment. The inventive load-bearing, insulating partially completed panels of a size and weight which can be carried by two workmen are set upright and secured in place one at a time according to the inventive method, where the concrete is then poured in the assembled panels to complete the structure of a wall.

The fact that partially completed panels are easily handled by two workmen is an extremely important feature of the present invention, because many prior panels have been designed so that they must be assembled into an entire wall before they can be simultaneously uprighted. Such prior methods require heavy equipment, are needlessly awkward to perform, and risk the health of the workmen to complete.

SUMMARY OF THE INVENTION

Bearing in mind the foregoing, it is a principal object of the invention to provide a unique panel building component, method of constructing the panel building component, and use of the component to assemble a wall that has superlative load-bearing capability.

Another principal object of the invention is to combine the concept of pre-fabrication for low cost and lightweight handling during construction placement with the load-bearing capability of reinforced concrete that is poured in place after panel placement.

A related object of the invention is the particular benefit of the panel being only partially completed at the time it is handled by workmen, lacking its final component of concrete, thereby making it lightweight to install, after which it is supplemented with rebar reinforceing rods and the concrete is poured in place.

Another object of the invention is the low cost in combination with the features of strong insulation properties, excellent structural qualities, and completion with a significant reinforced concrete component that magnifies the load-bearing capability of the resulting wall.

A further object of the invention is to provide a method of constructing a panel building component that produces an attractive, functional, and fire resistant structure.

An additional object of the invention is to provide a panel building component, method of making same, and method of assembly of a building wall that is advantageous when compared with and suitable for the replacement of concrete block construction.

A related object of the invention is to eliminate the waste as caused by the use of concrete blocks such as the additional ten percent builders normally order for breakage as well as the added waste when window and door openings are not eliminated from estimates.

Another related object of the invention is to eliminate the expense of labor skilled in the construction of concrete block walls.

A further object of the invention is to eliminate the need to supply additional materials to form tie beams and columns, as well as furring and field installed insulation.

Still another object of the invention is to facilitate applying finishing materials directly to the wall surface with quick and easy methods and materials.

One more object of the invention is to reduce construction site clean-up costs as is caused by block, stucco, furring, tie beam and column work.

Another object of the invention is to minimize time consuming and expensive inspections on columns and tie beams.

Yet another object is to utilize pre-fabrication using optimum materials assembled under plant controlled conditions because of its pre-fabrication characteristics.

An additional object of the invention is to mass produce a partially executed product in a high productivity and quality controlled environment at minimum cost.

A further object of the invention is to partially complete inventive panels in a manufacturing plant with pre-installed windows and pre-installed conduits for electricity and other installations.

A further object of the invention is to produce a panel building component which will not shrink, swell, or warp out of its designed shape, and will be unaffected by climatic changes, rot, or vermin.

One more object of the invention is to provide a load-bearing wall assembly which can be safely executed by two workmen without need of heavy equipment.

Other objects and advantages of the present invention will become apparent to those skilled in the art upon examination of the following detailed descriptions and the drawings.

In accordance with the principal aspect of the present invention, there is provided a panel building component, method of making same, and method of fabricating a load-bearing, insulating building wall. The building wall is formed on a foundation of a building.

The inventive panel building component includes at least one rigid expanded polymer insulation core (referred to for simplicity as a "foam core") having an interior face and an exterior face each having side edges, a top edge and a bottom edge; vertical C-studs preferably fabricated from light gauge steel and having a top end, a bottom end, a web portion, a flange portion on each side, a flange stiffener on the longitudinal edge of each flange which are disposed at the side edges of each foam core; a channel shaped foot member in engaging relationship with the bottom edge of the foam core and the bottom end of the C-studs, two siding members preferably fabricated from cement board, spacers to keep the foam core centered between the siding members when filling the panel building component with concrete, and the concrete itself when added in the field after placement. The foam core and C-studs are fabricated shorter than the finished height of the panel so that rebar steel reinforcing rods can be laid horizontally such that when the panel is filled with concrete, the top portion will be a concrete and rebar combination in the nature of a beam.

The method of making the inventive panel building component includes the following steps: placing a foam core having an interior face and an exterior face, side edges, a top end and a bottom end between C-studs preferably fabricated from light gauge steel and having a top end, a bottom end, a length, a web portion, a flange portion on each side and a flange stiffener on the longitudinal edge of each flange, such that the side edges of the foam core are engaged with the C-studs; placing a light gauge steel channel shaped foot member in engaging relationship with the bottom end of the foam core and the bottom end of the C-studs; locating spacers on the foam core; disposing two siding members in contact with the spacers and in engaging relationship with the C-studs; and joining the C-studs, the foot member, and the siding members together with fastening means. The method further includes installing rebar steel reinforcing rods horizontally such that when the panel is filled with concrete, the top portion will be a concrete and rebar combination in the nature of a beam.

The method of assembling a load-bearing wall includes the following steps: placing a first panel building component having a top void onto a foundation, orienting the panel in an upright position, securing the panel to the foundation, placing a second panel building component having a top void onto the foundation, orienting the second panel in an upright position adjacent to the first panel, securing the second panel to the foundation, positioning rebar horizontally in the top void of both panels, and filling both panels with concrete to form a tie beam required by applicable building codes. It may further include placing the panel into a recess in a foundation, drilling a hole into the foundation at each side of the panel and installing epoxy and round steel (rebar) vertically to secure the panel to the foundation. The method may further include the steps of applying external and internal finishes over the wall such as synthetic stucco and paint.

BRIEF DESCRIPTION OF THE DRAWINGS

The invention will be better understood upon reference to the following detailed description and the drawings in which.

DETAILED DESCRIPTION OF THE PREFERRED EMBODIMENTS

Figure 1:
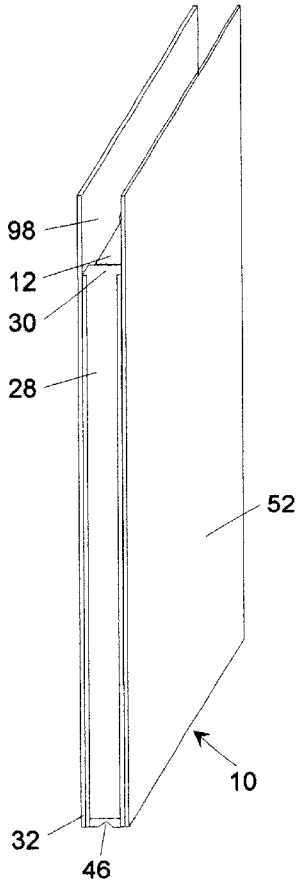
FIG. 1 is a perspective view of the panel building component, showing a top void for the placement of the tie beam.
Figure 2:
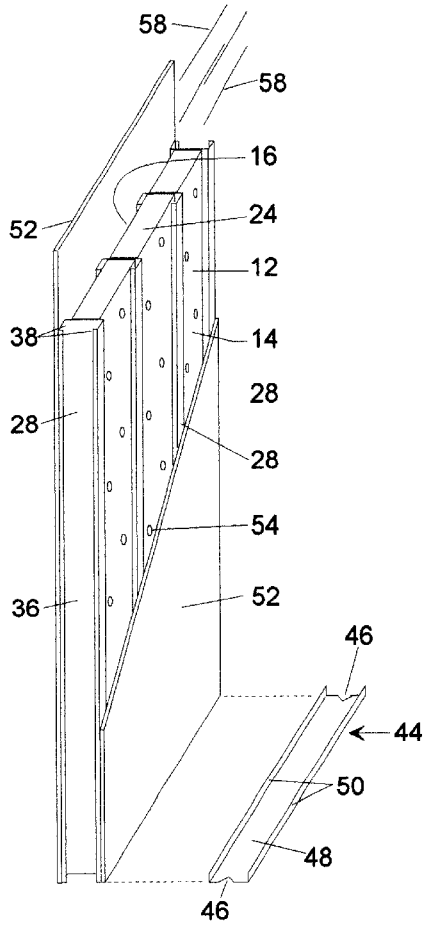
FIG. 2 is a perspective view of the panel building component with tie-beam rebar poised adjacent the top void, and with partial siding removed, showing the foam core, the C-studs, the channel shaped foot member, two cement board siding members, and spacers to keep the foam core centered when filling with concrete in the field.
Figure 3:
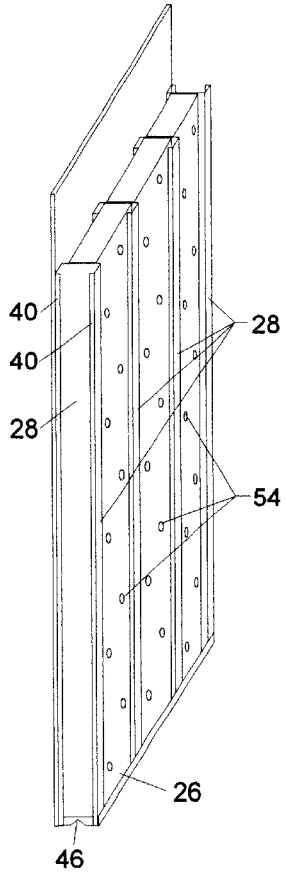
FIG. 3 is a perspective view of the panel building component with one siding removed, showing the rigid insulation core, the C-studs, a channel shaped foot member in place, and spacers to keep the foam core centered when filling with concrete in the field.

FIG. 1 illustrates in perspective view the inventive panel building component 10 prior to filling the same with concrete in the field. Foam core 12 is preferably formed of an expanded polystyrene or similar expanded polymeric material having a high insulative characteristic and substantial strength in compression. The foam core 12 has an interior face 14, an exterior face 16, side edges 22, a top end 24, and a bottom end 26. The height of the foam core 12 is less than the finished panel height by the depth of top void 98 into which is formed tie beam 94 when its rebar 58 is placed in top void 98 and the concrete 56 is poured. The foam core 12 is encased on its side edges 22 by vertical structural members termed C-studs 28. C-studs are preferably fabricated from light gauge steel and have a top end 30, a bottom end 32, a web 36, a flange 38 on each side, and a flange stiffener 40 on the longitudinal edge of each flange. The C-studs are installed with the open side facing outwardly. This is because when the panels 10 are placed adjacent each other in building a wall from them, they each form half of a vertical tube in which is disposed vertical steel rebar 58 and concrete 56 to form a steel and concrete column 64. The length of the C-studs 28 is less than the height of the finished panel by the depth of top void 98 in which is formed tie beam 94. As best seen in FIG. 2, the panel 10 further includes a foot member 44, which is preferably fabricated from a light gauge steel and is preferably in the shape of a channel having a web 48, and flanges 50. It is positioned with the opening facing upwardly as shown in FIG. 2. It is also notched 46 to allow for the extension of rebar 58 from the bottom of steel and concrete column 64 as described below in regard to FIGS. 5–7.

Figure 4:
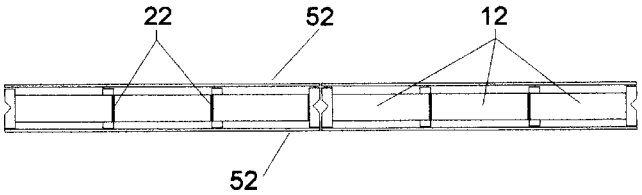
FIG. 4 is a top plan view showing two panels joined together in the field, prior to placement of tie beam rebars and filling with concrete.

The panel 10 also includes two siding members 52 preferably fabricated from cement board. Such material provides substantial aesthetics as well as adds additional support and insulative effects. Spacers 54 keep the foam core 12 centered between the siding members 52 when filling the panel building component 10 with concrete 56 after placement of the panel 10 on the foundation 72. In fact, when the panels are filled with concrete, three things happen: (1) concrete fills a void on both faces 14, 16 of the foam core 12, created by spacers 54; (2) a steel and concrete column 64 is completed between adjoining panels as seen in FIG. 4; and (3) the top portion will be a concrete and rebar combination tie beam 94 as required by applicable building codes. Of great importance is the fact that the panels are a relatively lightweight combination of a foam core 12, spacers 54, siding members 52, C-studs 28 and foot member 44 which can be readily moved about and positioned on the foundation 72 between vertical rebar 58 erected on the foundation and forming the core of the columns 64. Then the concrete 56 is poured in place.

Following installation of the panel in a construction site, wallpaper, paint, or other decorative materials may be readily applied to the interior facing. The external facing can have a synthetic stucco or other aesthetically pleasing surface applied.

Of greatest significance concerning this invention is the efficiency of materials in creating a building component of very light weight during installation and very great strength after the concrete is poured. The difference is truly striking. The columns are formed from a unique combination of (1) an outer surface, or vertical tube, formed from C-studs 28 of adjoining panels (see FIG. 4); (2) a central steel vertical rebar 58 the lower end of which interlocks with the foundation 72 in form of a dowell 62 (see FIGS. 5–7); and (3) concrete 56 which is poured in place. The result is an integral composite columns having greater strength than typical reinforced concrete columns because of the combination of the steel skin with the rebar and concrete that conventional columns are formed from.

Figure 5:
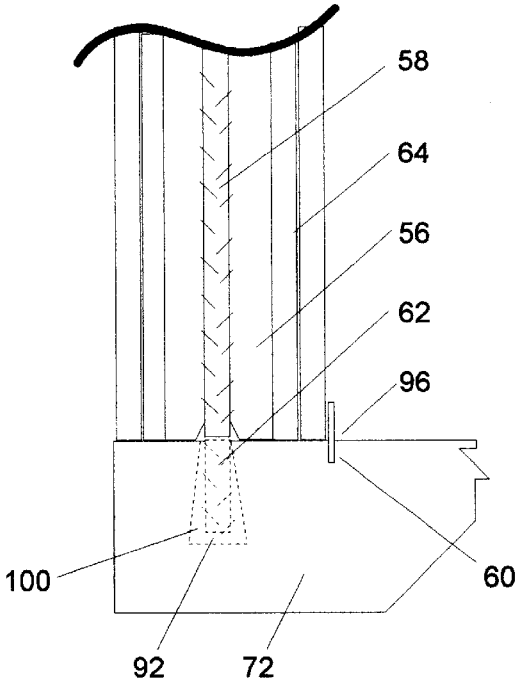
FIG. 5 is a fragmentary enlarged cross section view of a building foundation with a panel being installed with an alternate water stop and an epoxy adhered dowel in the column. This is the suggested method of installation fastening of the panels to the foundation and to each other.
Figure 6:
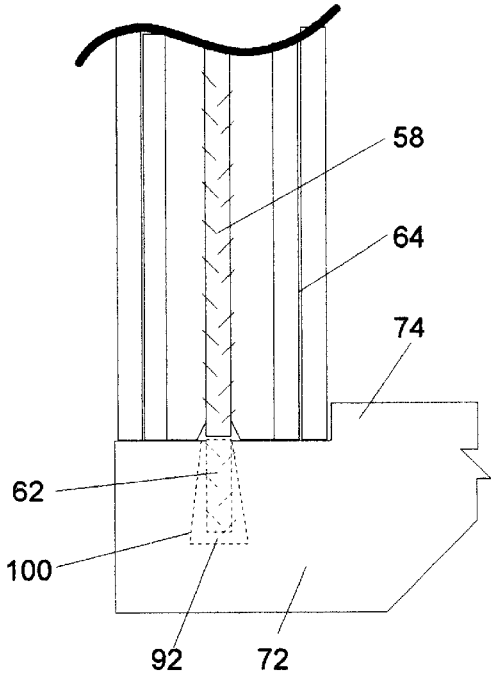
FIG. 6 is a fragmentary enlarged cross section view of the preferred embodiment building foundation fastening method with a panel being installed in a recess provided as a water stop and an epoxy adhered dowel in the column.
Figure 7:
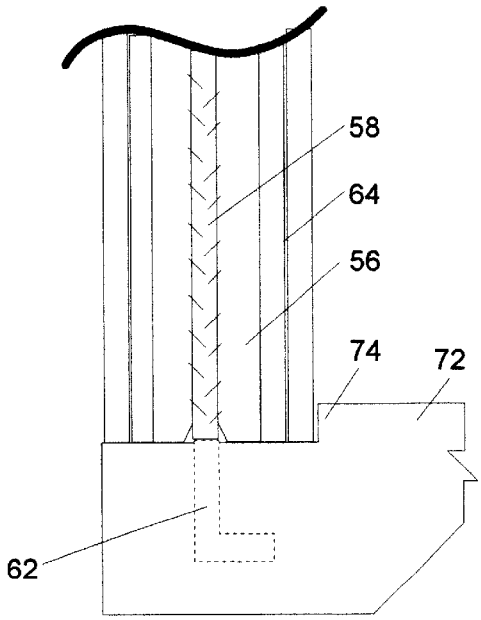
FIG. 7 is a fragmentary enlarged cross section view of another alternative embodiment building foundation fastening method with a panel being installed in a recess provided as a water stop and a pre-placed dowel, disposed in the foundation while the foundation finishing is taking place.

FIGS. 5–7 show a preferred and two alternative embodiments of the interconnection of the steel and concrete column 64 with the foundation 72. It will be recalled that foot member 44 was fabricated with foot member notch 46 to allow for the extension of rebar 58 from the bottom of steel and concrete column 64. This extension is referred to in the industry as a dowel 62, but it is simply the lower end of rebar 58 at the center of the steel and concrete column 64 which is attached to foundation 72 as shown either by the technique of FIGS. 5 and 6, or by that shown in FIG. 7. In FIGS. 5 and 6, a hole 100 is drilled into the foundation 72 at each side of the panel, the rebar 58 in inserted into the hole 100 and surrounded by a bonding agent, preferably epoxy 92 or a similar attaching means to secure the panel 10 to the foundation 72. FIGS. 5 and 6 show differing water stops. FIG. 5 shows an alternative water stop utilizing a light gauge galvanized steel strip 96 inserted into a groove 60 in foundation 72. FIGS. 6 and 7 show the interior floor 74 raised as a water stop, but with the dowell 62 installed differently. In the preferred embodiment of FIG. 6 the dowell is installed in hole 100 drilled into foundation 72 after the foundation is poured. In FIG. 7, the rebar 58 dowell 62 is bent and placed in position before foundation 72 is poured.

The spacers 54 provide a volume into which concrete 56 is poured from the top of the panel and to enter the panel in equal portions on either side of the foam core 12. The concrete 56 also enters the junction where the panels join creating a steel and concrete column 64 and making a permanent connection without external fasteners such as screws, or welding. The steel and concrete column 64, and the integral composite concrete walls with the foam core 12, the C-studs 28 and the rebar 58 utilize the significant advantage of the strength of reinfored concrete. The partially finished lightweight panel 10 in effect becomes a permanent form into which the concrete is poured to form a wall of great strength, composite composition, and with great economy, because the forms for pouring the concrete are not thrown away-they become a part of the resulting wall.

Figure 8:
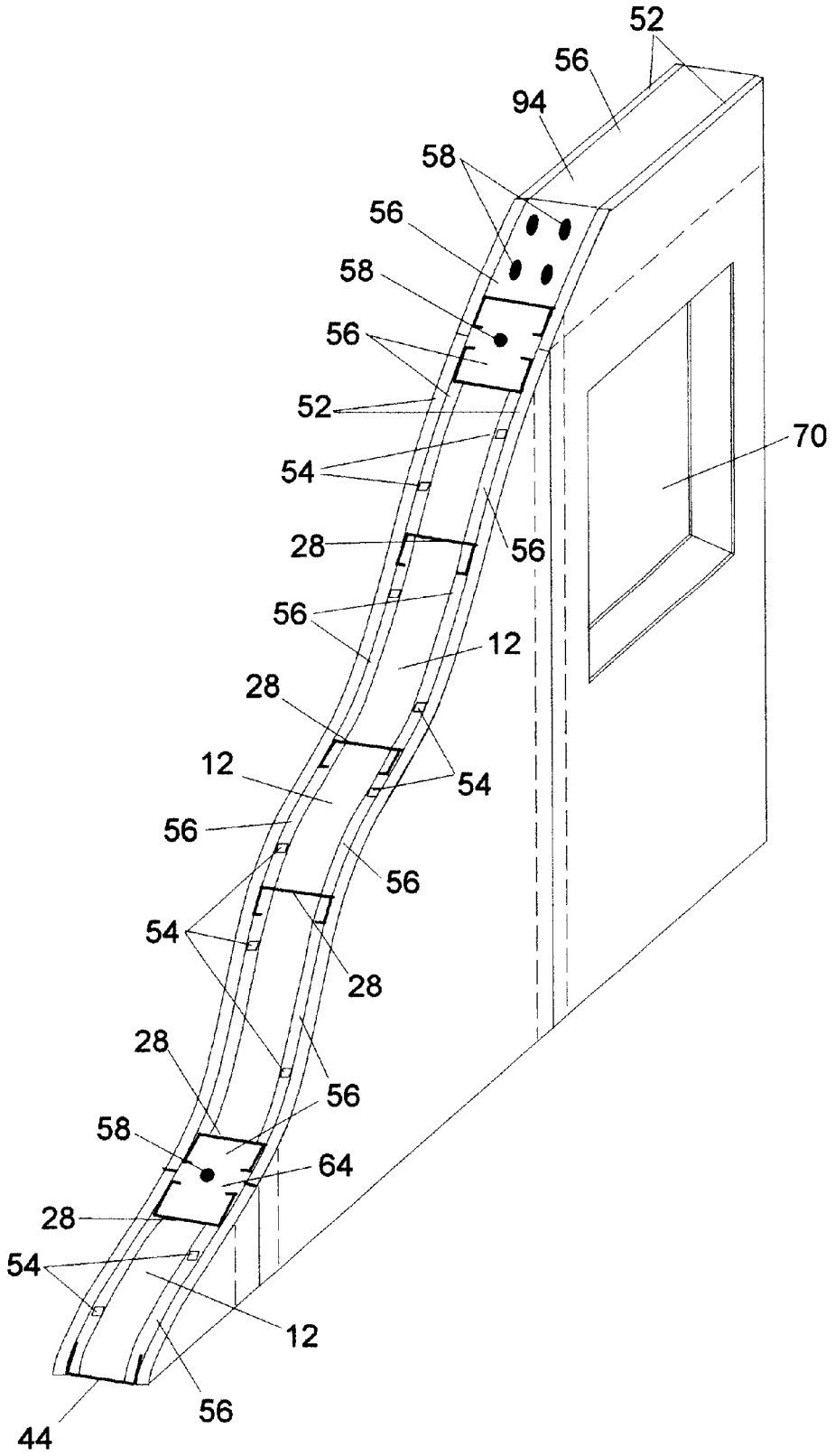
FIG. 8 is broken cross section view of a wall after all of the vertical and horizontal rebar has been installed and the concrete poured showing the tie beam and steel and concrete columns, and containing an opening for installation of a window.

Turning finally to the broken cross section view of FIG. 8, a portion of a completed wall is shown. Vertical and horizontal rebar 58 has been installed and the concrete 56 poured. This illustrates the tie beam 94, steel and concrete columns 64, and contains a window opening 70 for installation of a window. Also seen are C-studs 28, spacers 54, siding members 52, foot member 44, and foam core 12.

The method of making the inventive panel building component includes the following steps: The first step is the determination of the finished panel height. That is because a foam core 12 preferably formed of an expanded polystyrene or similar expanded polymeric material having a high insulative characteristic and substantial strength in compression must be sized to accomodate later creation of a concrete and steel tie beam 94 above the foam core 12. The next step is placing a foam core 12 having an interior face 14 and an exterior face 16, side edges 22, a top end 24 and a bottom end 26 between C-studs 28 preferably fabricated from light gauge steel and having a top end 30, a bottom end 32, a web portion 36, a flange 38 on each side and a flange stiffener 40 on the longitudinal edge of each flange 38, such that the side edges 22 of the foam core 12 are engaged with the C-studs 28; placing a light gauge steel channel shaped foot member 44 in engaging relationship with the bottom end 26 of the foam core 12 and the bottom end 32 of the C-studs 28; locating spacers 54 on the foam core 12; disposing two siding members 52 in contact with the spacers 54 and in engaging relationship with the C-studs 28; and joining the C-studs 28, the foot member 44, and the siding members 52 together. The method further includes installing rebar steel reinforcing rods 58 horizontally such that when the panel is filled with concrete 56, the top portion will be a concrete and rebar combination tie beam 94 as required by applicable building codes.

A method of fabricating a load-bearing, insulating wall is provided, which can be safely executed by two workmen without need of lifting equipment and which includes the following steps: drilling hole 100 in foundation 72 at each side of where each panel will be placed. The bottom end of vertical rebar 58 is placed in the hole 100, and forms dowell 62 which is held in place with epoxy 92 as shown in FIGS. 5 and 6. Alternatively, rebar 58 may be embedded in foundation 72 when it is initially poured as shown in FIG. 7, but in this instance the locations where the rebar is embedded must be precisely determined.

The vertical rebar 58 is placed in between C-studs at edges of adjoining panels. Then a first panel building component 10 having a top void 98 is placed onto a foundation 72, and the panel is oriented in an upright position between vertical rebars 58. Next, a second panel building component 10 having a top void 98 is placed onto the foundation 72, and it is oriented in an upright position adjacent to the first panel 10 between vertical rebars 58. Then rebar 58 is positioned horizontally in the top void 98 of both panels 10. Finally both panels, the top void 98 and the concrete and steel columns 64 are filled with concrete 56. At that point, the panels become partly concrete, each panel is disposed between reinforced concrete columns, and a reinforced concrete tie beam is formed across the top of the panels as required by applicable building codes. The method may further include the steps of applying external and internal finishes over the wall such as synthetic stucco and paint, and the installation of windows and doors in openings left for same when the panels are prefabricated at the factory. Finally, the number of C-studs 28 exceed the design parameters for light gauge steel framing for high wind and seismic loading. The finished concrete panels exceed the design parameters of concrete construction for high wind and seismic loading.

Having described the presently preferred embodiments of the invention, it should be understood that various changes in construction and arrangement will be apparent to those skilled in the art and fully contemplated herein without departing from the true spirit of invention. Accordingly, there is covered all alternatives, modifications and equivalents as may be included within the spirit and scope of the invention as defined in the appended claims.

What is claimed is:

1. A method of making a panel building component which comprises:

placing a substantially planar foam core the height of which is at least 12 inches less than the finished panel height between vertical C-studs, the length of which is substantially equal to the height of the foam core;

wherein a vertical C-stud running along the long edge of the panel is placed with the open side of the C-stud facing outwards towards the long edge of the panel;

placing a foot member in engaging relationship with the bottom end of the foam core and the bottom end of the C-studs;

locating spacers along opposite sides of the foam core and fastening the spacers to the core by means of glue or nails; and disposing two substantially planar siding members in contact with the spacers to form two substantially planar volumes on either side of the foam core, said siding members being disposed in engaging relationship with the C-studs and foot member, the siding members having a height substantially equal to the finished panel height and having a top void above the foam core and C-studs between the siding members.

2. A method of assembling a load-bearing wall comprising:

placing onto a foundation a first panel building component, supported b a brace during assembly, having two substantially planar volumes disposed on both sides of a substantially planar foam core using spacers to maintain separation between the foam core and substantially planar siding members, vertical C-studs disposed at the side edges of said foam core, the length of which is substantially equal to the length of the C-studs, a foot member in engaging relationship with the bottom end of the foam core and the bottom end of the C-studs, said panel building component having a top void;

orienting the first panel in an upright position;

securing the first panel to the foundation;

placing onto the foundation a second panel building component, supported by a brace during assembly, having two substantially planar volumes disposed on both sides of a substantially planar foam core using spacers to maintain separation between the foam core and substantially planar siding members, vertical C-studs disposed at the side edges of said foam core, the length of which is substantially equal to the length of the C-studs, a foot member in engaging relationship with the bottom end of the foam core and the bottom end of the C-studs, said panel building component having a top void;

orienting the second panel in an upright position;

drilling holes in the foundation, said holes are located at each side of where each said first and second panel will be placed;

inserting a bottom end of a vertical rebar in each hole to form a dowell; so that said rebar extends vertically between adjacent end to end first and second panels to a height equal to said planar foam core;

fixing the dowells in each hole with a bonding agent;

securing the second panel to the foundation;

positioning a plurality of rebar horizontally in the top void of the first and second panels; and pouring concrete between the foam core and siding members over the spacers to fill the panel;

pouring concrete between the vertical rebar and panel edge outwardly facing C-studs to form a reinforced concrete post between adjacent panels; and pouring concrete into the top void of both panels over said foam core and C-stud tops and horizontal rebar to form a reinforced horizontal tie beam.

3. The method of claim 1 which further comprises applying external and internal finishes over the wall.

* * * * *